United States Patent [19]

Heritier-Best

[11] Patent Number: 4,843,362

[45] Date of Patent: Jun. 27, 1989

[54] IGNITION COIL FOR INTERNAL COMBUSTION ENGINE

[75] Inventor: Pierre Heritier-Best, Issoire, France

[73] Assignee: Equipements Automobiles Marchal, Issy-les-Moulineaux, France

[21] Appl. No.: 162,710

[22] Filed: Mar. 1, 1988

[30] Foreign Application Priority Data

Mar. 4, 1987 [FR] France ..... 87 02910
Oct. 21, 1987 [FR] France ..... 87 14514

[51] Int. Cl.[4] ..... H01F 27/02; H01F 27/08

[52] U.S. Cl. ..... 336/61; 336/92; 336/96; 336/178

[58] Field of Search ..... 336/90, 92, 96, 98, 336/178, 61, 55; 264/272.19

[56] References Cited

U.S. PATENT DOCUMENTS 1,778,253 10/1930 Fischer ..... 336/96 X
3,201,728 8/1965 McWhirter ..... 336/60
3,668,583 6/1972 Nichols ..... 336/96 X
4,146,857 3/1979 Schleupen ..... 336/96 X
4,586,016 4/1986 Rilly et al. ..... 336/96

FOREIGN PATENT DOCUMENTS 2585412 1/1987 France .
60-192313 9/1985 Japan .

*Primary Examiner*—Thomas J. Kozma
*Attorney, Agent, or Firm*—Wenderoth, Lind & Ponack

[57] ABSTRACT

An ignition coil, for use particularly in the ignition of an automotive internal combustion engine, includes a central magnetic core member on each side of which is arranged at least one magnetic current return circuit member and two windings, one of which is a primary winding and the other a secondary winding, arranged coaxially around the central magnetic core member. The primary and secondary windings and the central magnetic core member are arranged within an inner casing and covered with synthetic resin. An outer casing encloses the assembly thus formed and surrounded wholly or partially by the magnetic current return circuit member.

11 Claims, 5 Drawing Sheets

FIG. 6
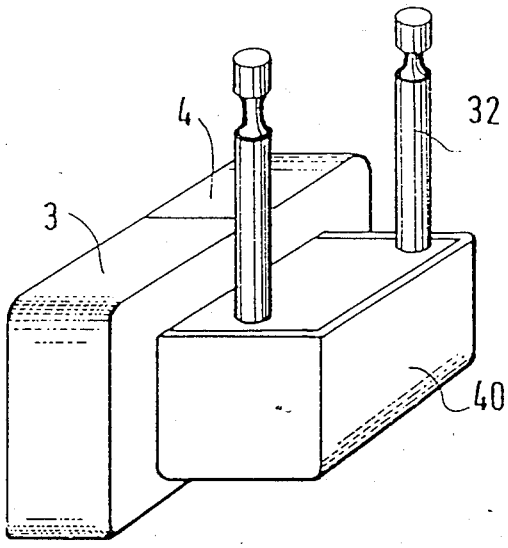
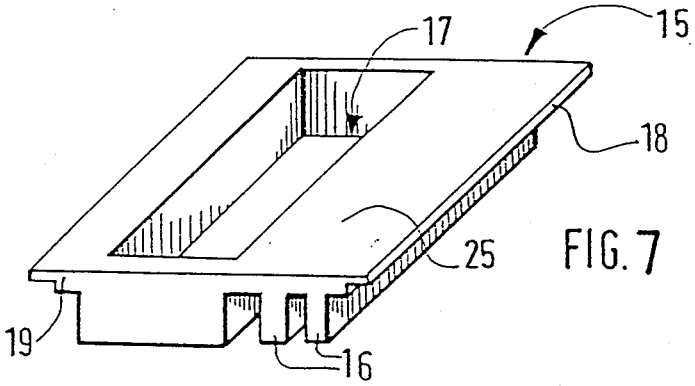
FIG. 7
FIG. 8
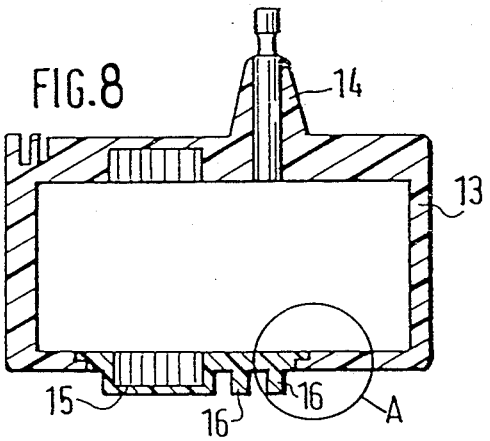
FIG. 9
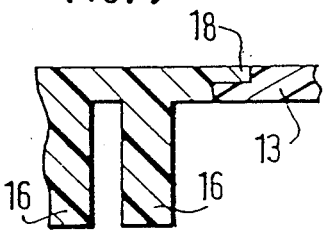

IGNITION COIL FOR INTERNAL COMBUSTION ENGINE

BACKGROUND OF THE INVENTION

The present invention is directed to an electrical transformer, especially an ignition coil for use particularly in an automotive internal combustion engine, and including generally a magnetic circuit and two windings, one primary and the other secondary.

In certain types of coils, the magnetic circuit includes a central magnetic core member surrounded coaxially by two plastic spools, one of which carries a primary winding and the other a secondary winding, and at least one magnetic current return circuit member located opposite the central magnetic core member.

French patent application 85-11458 discloses an ignition coil of the type described above in which the magnetic circuit and the primary and secondary spools are inserted into a plastic casing prior to pouring a synthetic resin into the casing to stabilize and insulate electrically the elements in the casing.

Ignition coils of this type, although pleasing in appearance, do not always meet the technical requirements demanded of them. When operating under full power, heat tends to cause the magnetic circuit in such coils to change shape and expand, which may produce cracks in the synthetic resin that holds it, thus compromising in spots the electrical insulation provided by the synthetic resin. This leads to the formation of current leaks from the high-voltage secondary winding toward the low-voltage primary winding or to the various metal parts of the ignition coil, e.g. the magnetic circuit.

French patent application 86-10664 would remove this drawback by placing a compressible sleeve between the synthetic resin and all or part of the magnetic circuit of the ignition coil. However, this arrangement sometimes proves insufficient when the magnetic circuit undergoes serious deformation and expansion.

One way of eliminating the problem while retaining the principle of encasing the magnetic circuit within a housing would be to use a synthetic resin having good dielectric properties and an expansion coefficient compatible with that of the magnetic circuit, thereby compensating for the deformation and expansion in the magnetic circuit while at the same time thoroughly insulating the ignition coil electrically. Unfortunately, no resin possessing these two characteristics is currently available at a price that would permit it to be used in competitively priced mass-production coils.

SUMMARY OF THE INVENTION

The present invention, which is intended to remove these drawbacks, provides an ignition coil suitable for use in the ignition of an automotive internal combustion engine, and including a second casing enclosing an assembly formed of the first casing and surrounded in whole or in part by the magnetic current return circuit member.

The second casing may be filled with a synthetic resin, or alternatively the second casing may be molded of synthetic resin about the assembly of the first casing and the magnetic current return circuit. In the latter case, a bottom portion of the outer casing may be molded to be open, and may be molded about a metal base employed as a heat dissipator.

BRIEF DESCRIPTION OF THE DRAWINGS

Other objects, features and advantages of the present invention will be apparent from the following detailed description, taken with the accompanying drawings, wherein:

FIG. 6 is a perspective view of an assembly of a first casing containing primary and secondary windings and surrounded by two magnetic current return circuit member;

FIG. 7 is a perspective view of a cooling base;

FIG. 8 is a cross section of an ignition coil incorporating the base in accordance with a further embodiment of the invention;

FIG. 9 is a cross-sectional view, on a larger scale, of detail A of FIG. 8;

DETAILED DESCRIPTION OF THE INVENTION

Figure 1:
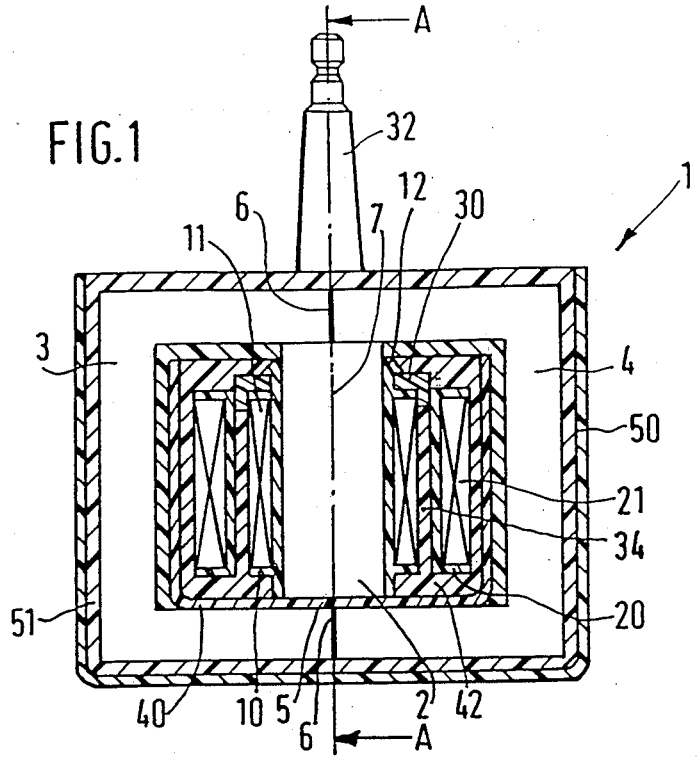
FIG. 1 is a cross section of an ignition coil according to one embodiment of the invention.
Figure 2:
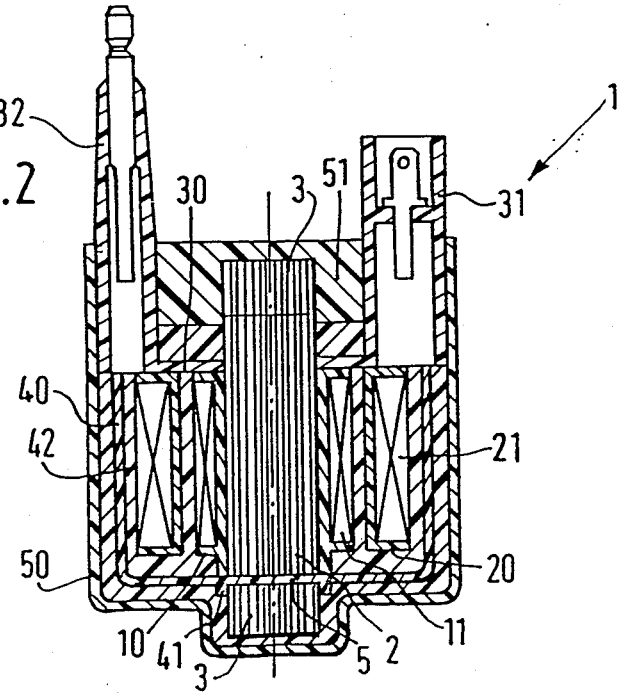
FIG. 2 is a cross section taken along line A-A in FIG. 1.
Figure 3:
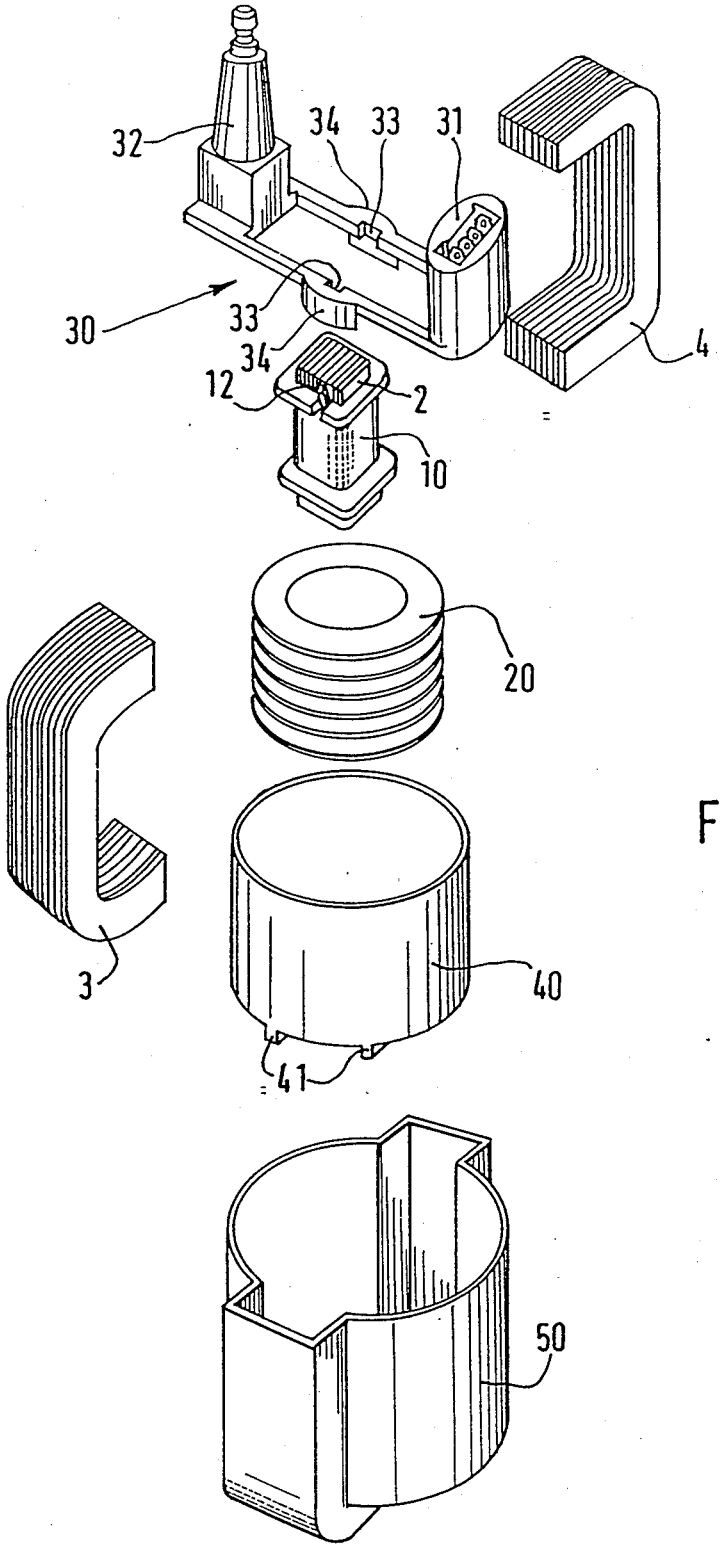
FIG. 3 is an exploded perspective view of the ignition coil according to FIG. 1 and 2.
Figure 4:
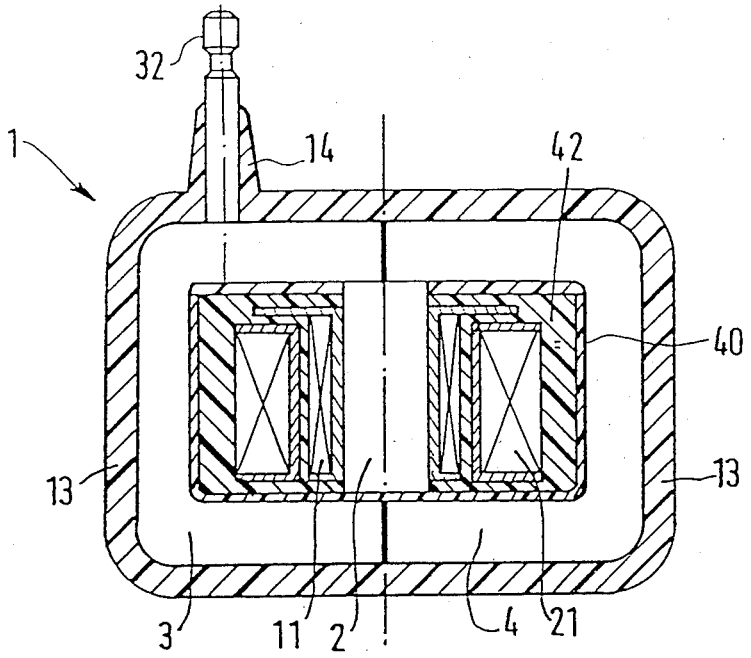
FIG. 4 is a cross section of an ignition coil according to another embodiment of the invention.

Ignition coil 1 as represented in FIGS. 1-3 includes a magnetic circuit produced from a set of stampings cut and assembled to form a central magnetic core member 2 and two C-shaped magnetic current return circuit members 3 and 4 arranged on either side of central magnetic core 2, with an airgap 5 located between one end of central magnetic core member 2 and magnetic current return circuit members 3 and 4. The two magnetic current return circuit member 3 and 4 are arranged on either side of central magnetic core member 2 in such a way that joints 6 formed by the assembly of magnetic current return circuit members 3 and 4 lie in the axis of symmetry of the magnetic circuit, represented by axis 7, so that the median line of magnetic flux will not pass through joints 6 and thereby convert joints 6 into two additional airgaps that would be harmful to the proper operation of the ignition coil.

Central magnetic core member 2 is lodged within the hub of a plastic spool 10, over which is wound the loops of a primary winding 11. An insulator 30, supporting a connector 31 for the primary low-voltage electrical circuit of coil 1 and a high-voltage outlet 32, snaps onto primary spool 10 over tabs 12 that are integral with primary spool 10 and that fit into corresponding recesses 33 in support insulator 30. A plastic spool 20, circular in section and having a secondary winding 21, surrounds primary spool 10, where it is tightly fitted over rounded sections 34 of insulator 30, which are provided for this purpose.

The assembly thus formed is housed within a first casing 40 of molded plastic having, an the external surface of its base, two guide ridges 41. Once the assembly consisting of the magnetic core members, windings, and support insulator has been positioned so that the lower end of central magnetic core member 2 makes good contact with the bottom of casing 40 and is located opposite that part of the bottom of casing 40 lying between ridges 41, as shown most clearly in FIG. 2, a layer of a first synthetic resin 42 with good dielectric properties is poured into casing 40, stabilizing and electrically insulating the various elements contained in casing 40. To aid in locating central magnetic core member 2 with respect to ridges 41, means (not shown) can be provided for positioning the core/windings/insulator assembly in relation to, and within, first casing 40.

The two magnetic current return circuit members 3 and 4 are then placed around casing 40 by being slipped between ridges 41 located beneath casing 40 so that circuit members 3 and 4 lie opposite the ends of central magnetic core member 2 and are in direct contact with central magnetic core member 2 at its upper end and through the wall of the base of casing 40 at its lower end. The thickness of the base of casing 40 is advantageously calibrated to serve as a gauge that defines the precise thickness of the desired airgap 5. Casing 40, surrounded by magnetic current return circuit members 3 and 4, is then replaced within a second casing 50, into which is poured a second synthetic resin 51, which differs from the first synthetic resin 42 in that it has an expansion coefficient compatible with the expansion and deformation of the double magnetic current return circuit member and heat conducting properties adequate to allow it to channel off the heat produced in the magnetic circuit during operation of ignition coil 1. Synthetic resins of this type are presently commercially available, and one of ordinary skill in the art would know the types of synthetic resins to be employed to form both the first and second layers 42, 51.

In this way, the second layer of synthetic resin 51 will withstand the deformations to which the magnetic circuit is subject when hot, without risk of breaking the insulation of secondary winding 21 provided by the first layer of synthetic resin 42.

The embodiment represented in FIGS. 4-11 differs from that presented above essentially in that outer casing 13 is advantageously molded directly over inner casing 40 and magnetic current return circuit members 3 and 4. The synthetic resin that makes up casing 13 is advantageously a good conductor of heat so that it will help dissipate the heat produced by the magnetic circuit. The expansion coefficient of casing 13 should allow casing 13 to withstand the deformations produced in the magnetic circuit as it heats up.

An ignition coil 1 produced in this way has the advantage of not requiring the step of filling the second casing with synthetic resin as in the above discussed embodiment of FIGS. 1-3. The dielectric properties provided in that step are obtained directly through the properties of the material making up the outer casing. In the process of molding outer casing 13, the opening(s) 14 for high-voltage terminal(s) 32 is (are) advantageously formed integrally with the casing, with high-voltage output terminal(s) 32 being already set in place when inner casing 40 is molded.

Figure 5:
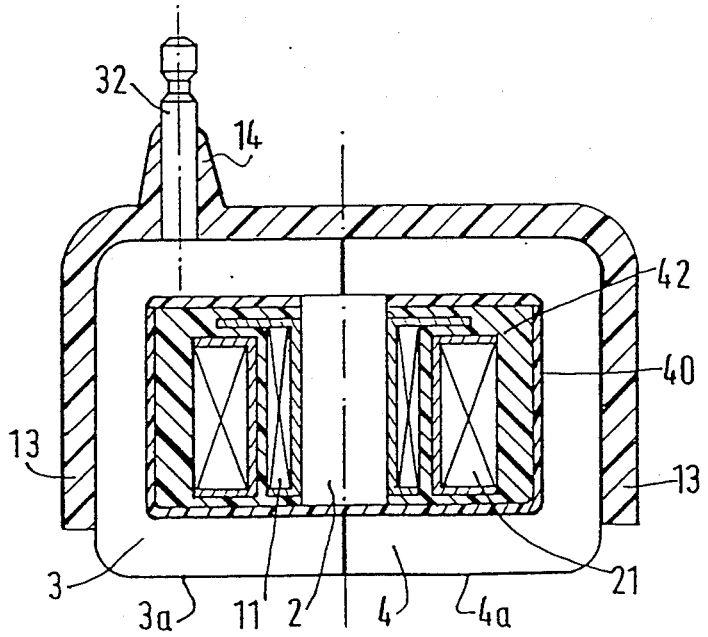
FIG. 5 is a cross section of an ignition coil similar to FIG. 4, but showing a modification thereof.

According to another variant of this embodiment of the invention shown in FIG. 5 and intended to improve the dissipation of the heat generated by magnetic current return circuit members 3 and 4, all or part of the lower legs 3a, 4a of magnetic current return circuit members 3 and 4 are left exposed when outer casing 13 is molded.

According to yet another variant of this embodiment of the invention, shown in FIGS. 6 through 8 and also designed to provide better dissipation of the heat produced by magnetic current return circuit member 3 and 4, a metal base 15 is inserted into the open portion of the sheathing of outer casing 13 during the molding operation. Metal base 15 includes a recess 17 having dimensions corresponding to the outer dimensions of magnetic current return circuit member 3 and 4 so that such circuit member, when partially lodged within recess 17, will be in close contact with the surfaces thereof, thus permitting good dissipation of heat. One of the lateral edges of recess 17 extends outwardly to form a support 25 having cooling fins 16. Metal base 15 therefore acts as a radiator.

Prior to molding outer casing 13, inner casing 40, surrounded by magnetic current return circuit members 3 and 4, is inserted into metal base 15, with the bottom of magnetic current return circuit members 3 and 4 lodged in recess 17 and the bottom of inner casing 40 in thermal contact with support 25. The assembly thus formed is placed in a mold, into which resin is poured to form outer casing 13.

The metal base, which remains exposed, is anchored in the molded piece by means of lateral edges 18 and 19 shaped so that when the outer casing is cast, the synthetic resin will flow into recesses provided for this purpose in edges 18 and 19 (FIGS. 8 and 9).

Figure 10:
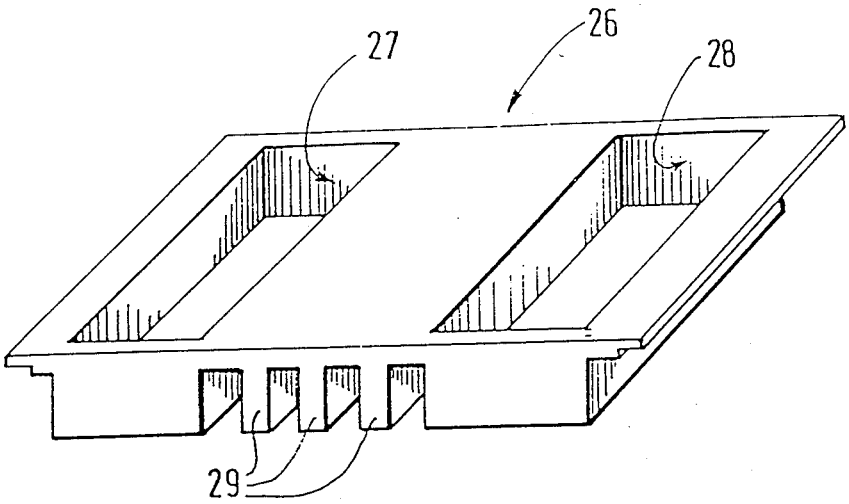
FIG. 10 is a perspective view of a base for a double coil in accordance with a variant of the invention.
Figure 11:
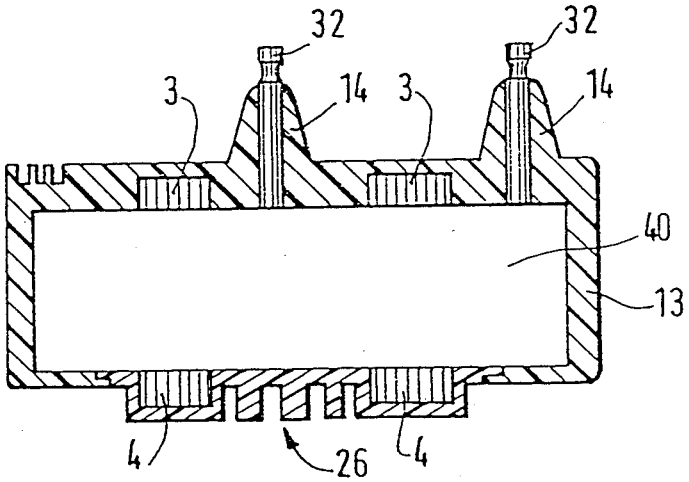
FIG. 11 is a cross-section of an ignition coil according to the variant depicted in FIG. 10.

The variant shown in FIGS. 10 and 11 is distinguished in that the invention is applied to a double ignition coil. For this purpose, a metal base 26 contains two recesses 27 and 28 that each accommodate a magnetic circuit in the manner shown for the preceding embodiment, with fins 29 provided between recesses 27 and 28.

Although the present invention has been described and illustrated with respect to preferred features thereof, it is to be understood that various modifications and changes may be made to the specifically described and illustrated features without departing from the scope of the present invention. Thus, for example, the magnetic current return circuit members 3 and 4 obviously could be replaced with a single C-shaped circuit member.

I claim:

1. An ignition coil, particularly for use in an automotive internal combustion engine, comprising:

a central magnetic core member surrounded coaxially by a primary winding and a secondary winding;

the assembly formed by said central magnetic core member and said primary and secondary windings being arranged within an inner insulating casing with an end of said central magnetic core member confronting a bottom wall of said inner insulated casing;

a first synthetic resin filling said inner insulating casing and stabilizing therein said assembly and electrically insulating the elements thereof;

first and second magnetic current return circuit members positioned about said inner insulating casing on opposite sides of said central magnetic core member;

said bottom wall of said inner insulating casing having on the exterior thereof means for aligning first ends of said first and second magnetic current return circuit members in confronting arrangement at a position confronting said end of said central magnetic core member and separated therefrom by said bottom wall of said inner insulating casing, such that the thickness of said bottom wall defines an air gap between said end of said central magnetic core member and said first ends of said first and second magnetic current return circuit members;

said assembly with said first and second magnetic current return circuit members being arranged within an outer insulating casing; and a second synthetic resin filling said outer insulating casing and stabilizing and entirely enclosing therein said assembly and said first and second magnetic current return circuit members, said second synthetic resin having good heat conducting properties and an expansion coefficient that is compatible with that of said first and second magnetic current return circuit members.

2. An ignition coil as claimed in claim 1, wherein said first and second magnetic current return circuit members each have a substantially C-shaped configuration, and second ends in abutment and in abutment with another end of said central magnetic core member.

3. An ignition coil as claimed in claim 2, wherein said first ends and said second ends of said first and second magnetic current return circuit members confront at respective locations coaxial with an axis of symmetry of a magnetic circuit formed by said central magnetic core member and said first and second magnetic current return circuit members.

4. An ignition coil as claimed in claim 1, wherein said first synthetic resin has good dielectric properties and is a material different than said second synthetic resin.

5. An ignition coil, particularly for use in an automotive internal combustion engine, comprising:

a central magnetic core member surrounded coaxially by a primary winding and a secondary winding;

an assembly formed by said central magnetic core member and said primary and secondary windings being arranged within an inner insulating casing with an end of said central magnetic core member confronting a bottom wall of said inner insulating casing;

a first synthetic resin filling said inner insulating casing and stabilizing therein said assembly and electrically insulating the elements thereof;

first and second magnetic current return circuit members positioned about said inner insulating casing on opposite sides of said central magnetic core member;

said bottom wall of said inner insulating casing having on the exterior thereof means for aligning first ends of said first and second magnetic current return circuit members in confronting arrangement at a position confronting said end of said central magnetic core member and separated therefrom by said bottom wall of said inner insulating casing, such that the thickness of said bottom wall defines an air gap between said end of said central magnetic core member and said first ends of said first and second magnetic current return circuit members; and an outer insulating casing formed of a second synthetic resin and molded over and at least partially enclosing said assembly and said first and second magnetic current return circuit members, said second synthetic resin having good heat conducting properties and an expansion coefficient that is compatible with that of said first and second magnetic current return circuit members.

6. An ignition coil as claimed in claim 5, wherein said first and second magnetic current return circuit members each have a substantially C-shaped configuration, and second ends in abutment and in abutment with another end of said central magnetic core member.

7. An ignition coil as claimed in claim 5, wherein said first ends and said second ends of said first and second magnetic current return circuit members confront at respective locations coaxial with an axis of symmetry of a magnetic circuit formed by said central magnetic core member and said first and second magnetic current return circuit members.

8. An ignition coil as claimed in claim 5, wherein said outer insulating casing entirely encloses said assembly and said first and second magnetic current return circuit members.

9. An ignition coil as claimed in claim 5, wherein said outer casing includes at least one high-voltage output opening formed integrally from said second synthetic resin during molding thereof.

10. An ignition coil as claimed in claim 5, wherein said outer casing includes a lower open portion into which extends a metal base that accommodates lower portions of said first and second magnetic current return circuit members.

11. An ignition coil as claimed in claim 5, wherein said first synthetic resin has good dielectric properties and is a material different than said second synthetic resin.

* * * * *